US010598056B2

(12) United States Patent
Koide et al.

(10) Patent No.: US 10,598,056 B2
(45) Date of Patent: Mar. 24, 2020

(54) INTERNAL COMBUSTION ENGINE

(71) Applicant: HONDA MOTOR CO., LTD., Tokyo (JP)

(72) Inventors: Keijiro Koide, Wako (JP); Shigekazu Tanaka, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 220 days.

(21) Appl. No.: 15/872,443

(22) Filed: Jan. 16, 2018

(65) Prior Publication Data

US 2018/0238205 A1 Aug. 23, 2018

(30) Foreign Application Priority Data

Feb. 23, 2017 (JP) ..... 2017-032481

(51) Int. Cl.

| | |
|---|---|
| ***F01L 9/02*** | (2006.01) |
| ***F01M 9/10*** | (2006.01) |
| ***F01P 3/02*** | (2006.01) |
| ***F01M 5/00*** | (2006.01) |
| ***F01M 9/00*** | (2006.01) |
| *F01L 1/24* | (2006.01) |
| *F01P 5/10* | (2006.01) |
| *F01P 3/00* | (2006.01) |
| *F01L 1/18* | (2006.01) |
| *F01L 1/053* | (2006.01) |
| *F01L 13/00* | (2006.01) |

(52) U.S. Cl.

CPC ..... *F01M 9/105* (2013.01); *F01M 5/001* (2013.01); *F01M 9/00* (2013.01); *F01P 3/02* (2013.01); *F01L 1/185* (2013.01); *F01L 1/2405* (2013.01); *F01L 13/0036* (2013.01); *F01L 2001/0537* (2013.01); *F01L 2001/2444* (2013.01); *F01L 2105/00* (2013.01); *F01L 2810/02* (2013.01); *F01P 5/10* (2013.01); *F01P 2003/006* (2013.01); *F01P 2003/024* (2013.01)

(58) Field of Classification Search

CPC ..... F01M 9/00; F01M 9/105; F01M 5/001; F01P 3/02; F01P 2003/006; F01P 2003/024; F01P 5/10; F01L 13/0036; F01L 2001/0537; F01L 2001/2444; F01L 2105/00; F01L 2810/02; F01L 1/185; F01L 1/2405

See application file for complete search history.

(56) References Cited

U.S. PATENT DOCUMENTS 5,123,385 A * 6/1992 Sado ..... F01L 1/02 123/193.5

FOREIGN PATENT DOCUMENTS

JP 2016044571 A 4/2016

* cited by examiner

*Primary Examiner* — Zelalem Eshete
(74) *Attorney, Agent, or Firm* — Armstrong Teasdale LLP

(57) ABSTRACT

An internal combustion engine includes: a cylinder head (3); a combustion chamber recess (15) formed in the cylinder head; an intake passage (16) and an exhaust passage (17) formed in the cylinder head and communicating with the combustion chamber recess; a head oil passage (80) formed in the cylinder head, and having a first end (81A) communicating with an oil pump (62) and a second end (81B) opening out at a sliding contact surface of a valve actuating mechanism (23) provided in the cylinder head; and an oil jacket (84) formed in the cylinder head in a path of the head oil passage so as to at least partly surround the exhaust passage.

10 Claims, 8 Drawing Sheets

INTERNAL COMBUSTION ENGINE

TECHNICAL FIELD

The present invention relates to an internal combustion engine, and in particular to an internal combustion engine provided with an improved lubrication system for a valve actuation mechanism.

BACKGROUND ART

In the field of internal combustion engines, it is known to provide an oil pump driven by a crankshaft of the engine, and an oil passage system provided in a cylinder block and a cylinder head of the engine to supply the lubricating oil pressurized by the oil pump to sliding parts of a valve actuation mechanism of the engine. See JP2016-044571A, for instance.

SUMMARY OF THE INVENTION

When the engine is not warmed up, because the viscosity of the lubricating oil is high owing to the low temperature thereof, frictional loss in the sliding parts is significant. It is therefore desirable to increase the temperature of the lubricating oil as quickly as possible once the engine is started. The temperature of the lubricating oil is increased as the lubricating oil passes through the oil passages formed in the cylinder block and the cylinder head. Since the cylinder block and the cylinder head are cooled by cooling water circulating in an oil jacket formed in the cylinder block and the cylinder head, the temperature of the lubricating oil does not substantially increase beyond the temperature of the cooling water. However, in terms of viscosity and lubricating performance, the optimum temperature of the lubricating oil is somewhat higher than the temperature of the cooling water. Therefore, the lubricating oil is prevented from performing in an optimum manner according to the conventional arrangement.

SUMMARY OF THE INVENTION

In view of such a problem of the prior art, a primary object of the present invention is to provide an internal combustion engine in which the temperature of the lubricating oil can be maintained at an optimum level.

A second object of the present invention is to provide an internal combustion engine in which the temperature of the lubricating oil can be increased quickly after the engine is started.

To achieve such an object, the present invention provides an internal combustion engine (1), comprising: a cylinder head (3); a combustion chamber recess (15) formed in the cylinder head; an intake passage (16) and an exhaust passage (17) formed in the cylinder head and communicating with the combustion chamber recess; a head oil passage (80) formed in the cylinder head, and having a first end (81A) communicating with an oil pump (62) and a second end (81B) opening out at a sliding contact surface of a valve actuating mechanism (23) provided in the cylinder head; and an oil jacket (84) formed in the cylinder head in a path of the head oil passage so as to at least partly surround the exhaust passage.

The lubricating oil to be supplied to the sliding contact surface of the valve actuating mechanism is heated by the exhaust gas via a wall defining the exhaust passage so that the temperature of the lubricating oil can be increased beyond the temperature of the engine cooling water. Since the oil jacket is formed in the cylinder head in which the valve actuating mechanism is provided, the lubricating oil can be supplied to the sliding contact surface of the valve actuating mechanism substantially without lowering the temperature thereof. Furthermore, the part of the cylinder head adjoining the exhaust passage can be favorably cooled by the lubricating oil flowing through the oil jacket.

Preferably, the oil jacket is provided with a larger cross sectional area than an adjoining part of the head oil passage.

Thereby, the velocity of the lubricating oil is reduced in the oil jacket so that the heat can be favorably transferred from the cylinder head to the lubricating oil in the oil jacket.

According to a preferred embodiment of the present invention, the cylinder head is provided with a plurality of combustion chamber recesses, and the exhaust passage includes a plurality of branch passages (18) communicating with the respective combustion chamber recesses, and a collecting passage (19) connected to downstream ends of the branch passages and opening out at a side of the cylinder head, the oil jacket being positioned adjacent to the collecting passage.

Because the oil jacket can be formed around the collecting passage into which the branch passages merge, a space for accommodating the oil jacket can be conveniently created adjacent to the collecting passage. In particular, because the oil jacket can be positioned to a close proximity of the collecting passage, the size of the cylinder head is not required to be increased.

The oil jacket may be positioned on a side of the collecting passage.

Thereby, the size of the cylinder head is not required to be increased on account of the oil jacket.

Preferably, the oil jacket has an upper edge positioned above an upper end of the collecting passage, and a lower edge positioned below a lower end of the collecting passage.

Thereby, the surface area of the oil jacket for receiving heat from the collecting passage can be maximized so that the heat from the collecting passage can be efficiently conducted to the lubricating oil in the oil jacket.

According to a preferred embodiment of the present invention, the oil jacket includes a first oil jacket (84A) positioned on one side of the collecting passage and a second oil jacket (84B) positioned on another side of the collecting passage; and the head oil passage includes an upper connecting oil passage (86) extending above the collecting passage and connecting the first oil jacket with the second oil jacket and/or a lower connecting oil passage (101) extending below the collecting passage and connecting the first oil jacket with the second oil jacket, an upstream oil passage (85) connecting the first oil jacket with the oil pump, and a downstream oil passage (87) connecting the second oil jacket with the second end of the head oil passage.

Because the lubricating oil which is discharged from the oil pump is heated in the first oil jacket and the second oil passage before being supplied to the sliding contact surface of the valve actuating mechanism, the lubricating oil of a relatively high temperature can be supplied to the sliding contact surface of the valve actuating mechanism.

According to a particularly preferred embodiment of the present invention, the head oil passage includes both the upper connecting oil passage and the lower connecting oil passage, and is further provided with a discharge passage (102) extending from a lower end of the first oil jacket to the upstream oil passage with a downward incline, the lower connecting oil passage extending from the second oil jacket to the first oil jacket horizontally or with a downward inline.

Owing to this arrangement, when the engine is not in operation, the lubricating oil in the second oil jacket is conducted to the first oil jacket via the lower connecting oil passage, and the lubricating oil in the first oil jacket is conducted to the upstream oil passage via the discharge passage so that the lubricating oil is prevented from remaining in the first oil jacket and the second oil jacket.

Preferably, the internal combustion engine provided with this arrangement comprises a one-way valve (103) in the discharge passage allowing a flow from the first oil jacket to the upstream oil passage.

Thereby, when the oil pump is in operation, and the upstream oil passage is therefore higher in pressure than the first oil jacket, the discharge passage is closed by the one-way valve so that the lubricating oil is allowed to flow from the upstream passage to the first oil jacket in a stable manner.

According to a preferred embodiment of the present invention, the oil jacket includes a first oil jacket (84A) positioned on one side of the collecting passage and a second oil jacket (84B) positioned on another side of the collecting passage; the head oil passage includes an upper connecting oil passage (86) extending above the collecting passage and connecting the first oil jacket with the second oil jacket, an upstream oil passage (85) connecting the first oil jacket with the oil pump, and a downstream oil passage (87) connecting the second oil jacket with the second end of the head oil passage; the cylinder head is provided with an upper water jacket (54) formed above the exhaust passage and a lower water jacket (53) formed under the exhaust passage; and the upper connecting oil passage is positioned more toward a downstream end of the collecting passage than an edge of the upper water jacket on a side of the downstream end of the collecting passage.

Thereby, the upper connecting oil passage is directly exposed to the collecting passage without being interposed by the upper water jacket so that the lubricating oil can be heated to a higher temperature than the cooling water.

According to a preferred embodiment of the present invention, the first oil jacket and the second oil jacket are positioned more toward the downstream end of the collecting passage than the edge of the upper water jacket on the side of the downstream end of the collecting passage.

Thereby, the first oil jacket and the second oil jacket are directly exposed to the collecting passage without being interposed by the upper water jacket so that the lubricating oil can be heated to a higher temperature than the cooling water.

Preferably, the second end of the head oil passage opens out at a sliding contact surface of a bearing (34) provided on the cylinder head for rotatably supporting a camshaft (28).

Thereby, the lubricating oil is supplied to the sliding contact surface of the bearing after being heated in the oil jacket so that the frictional loss of the bearing can be minimized.

Preferably, the second end of the head oil passage opens out at a lash adjuster receiving hole (44) formed in the cylinder head for supporting a lash adjuster (41).

Thereby, the lubricating oil is supplied to the sliding contact surface of the lash adjuster after being heated in the oil jacket so that the frictional loss of the lash adjuster can be minimized.

Thus, according to the present invention, the lubricating oil can be heated to a higher temperature than the cooling water of the engine.

DESCRIPTION OF THE PREFERRED EMBODIMENT(S)

Preferred embodiments of the present invention are described in the following with reference to the appended drawings.

First Embodiment

Figure 1:
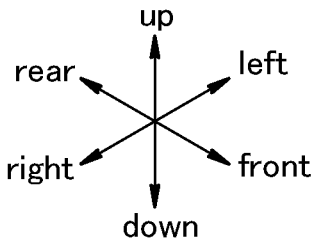
FIG. 1 is a see-through perspective view of an internal combustion engine according to a first embodiment of the present invention.
Figure 1:
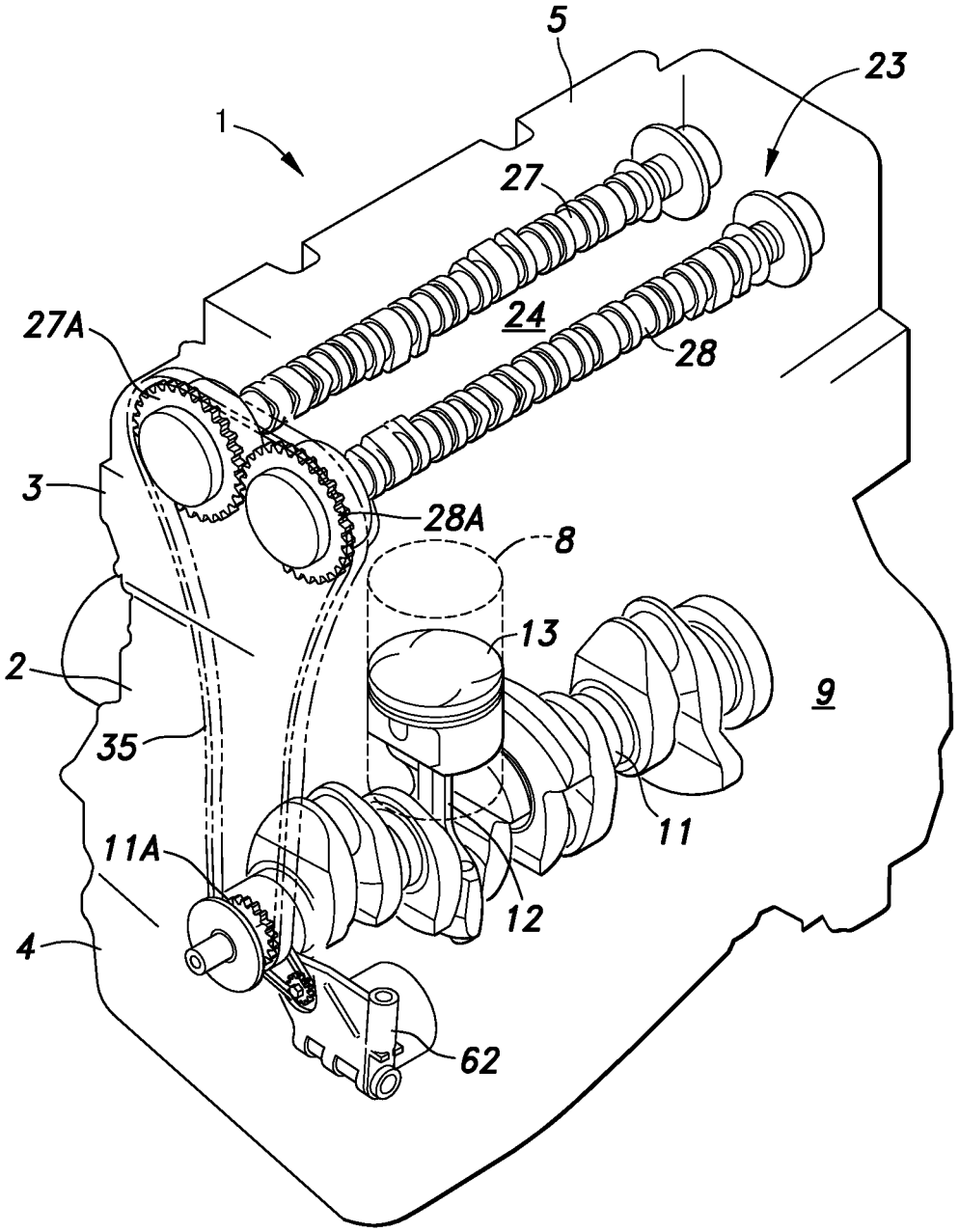
Figure 2:
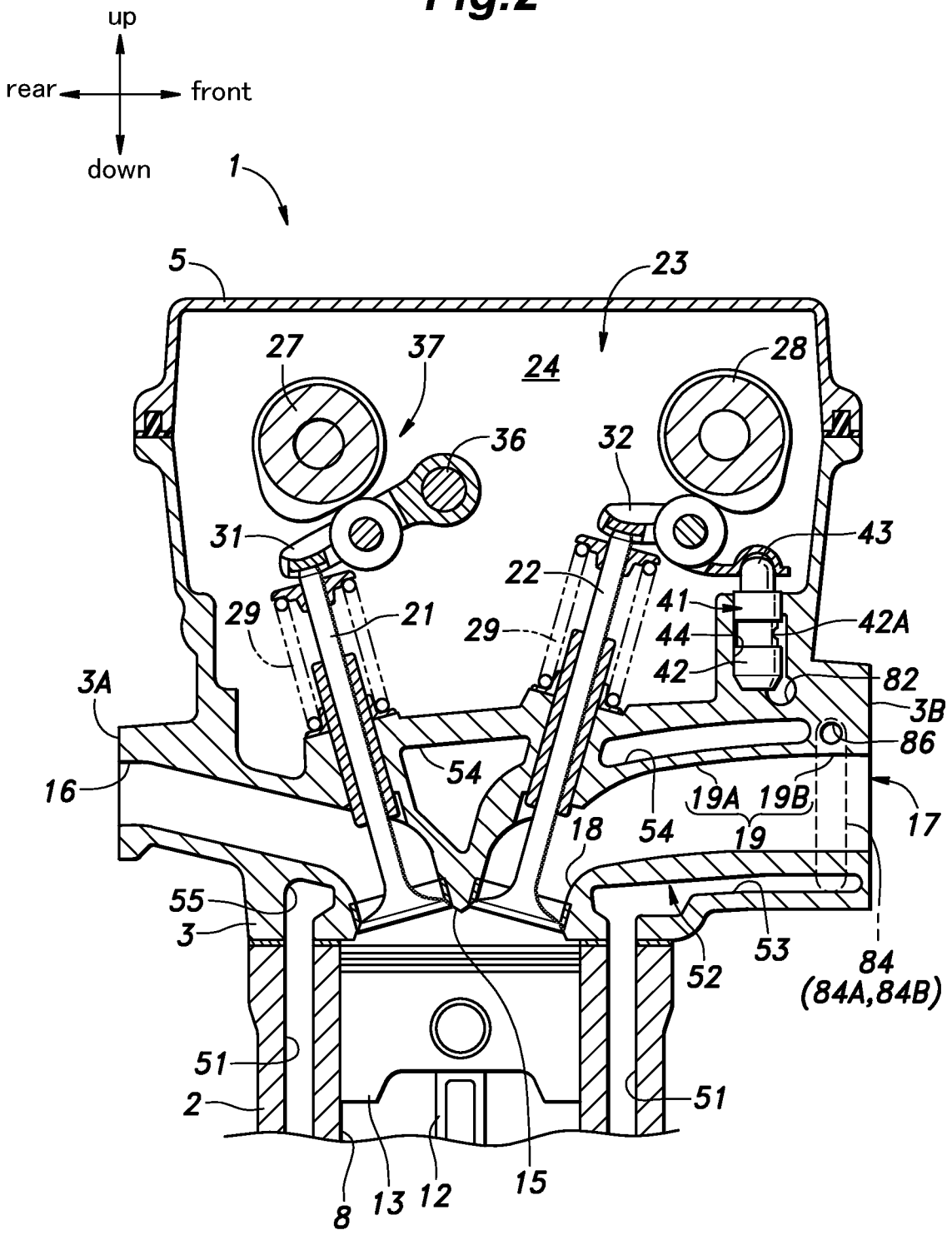
FIG. 2 is a fragmentary sectional view of the internal combustion engine.

In a first embodiment of the present invention shown in FIGS. 1 and 2, an internal combustion engine 1 of a motor vehicle includes a cylinder block 2, a cylinder head 3 coupled to an upper end of the cylinder block 2, an oil pan 4 coupled to a lower end of the cylinder block 2, and a head cover 5 coupled to an upper end of the cylinder head 3. As shown in FIG. 2, a plurality of cylinders 8 are formed in an upper part of the cylinder block 2. The upper end of each cylinder 8 opens to the upper end surface of the cylinder block 2 and the lower end thereof communicates with a crank chamber 9 formed in the lower part of the cylinder block 2. The cylinders 8 are arranged in parallel to each other, and in a single row. The direction in which the cylinders 8 are arranged is referred to as a cylinder row direction. In the present embodiment, the cylinder row direction may also be referred to as a lateral direction on account of the fact that the engine 1 is laterally mounted on the vehicle.

In the crank chamber 9, a crankshaft 11 is rotatably supported by the cylinder block 2, and is disposed in parallel to the cylinder row direction. The crankshaft 11 is coupled to pistons 13 slidably received in the respective cylinders 8 via respective connecting rods 12.

The lower part of the crank chamber 9 is closed by the oil pan 4 which stores lubricating oil therein.

As shown in FIG. 2, the cylinder head 3 defines combustion chamber recesses 15 each communicating with an intake passage 16 and an exhaust passage 17 formed in the cylinder head 3. Each combustion chamber recess 15 is formed on the lower end surface of the cylinder head 3 at a position corresponding to the corresponding cylinder 8. The combustion chamber recess 15 is recessed upward, and closes the upper end of the corresponding cylinder 8. The combustion chamber recess 15 cooperates with the wall face of the cylinder 8 and the piston 13 to define a combustion chamber. Inner end portions of the intake passage 16 and the exhaust passage 17 open out to the combustion chamber recess 15.

Figure 4:
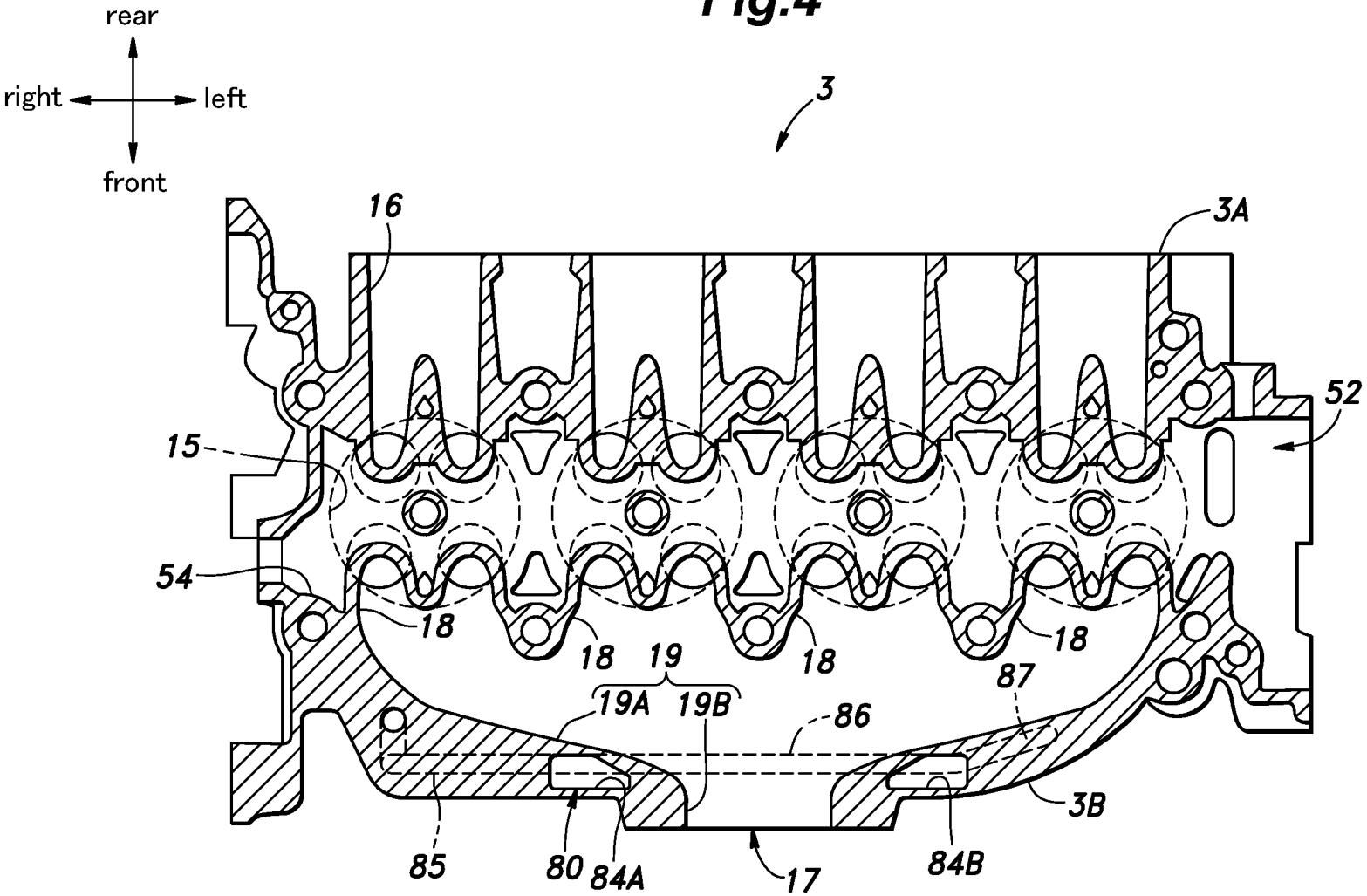
FIG. 4 is a horizontal sectional view of the cylinder head.

As shown in FIGS. 2 and 4, each intake passage 16 includes a pair of downstream sections extending from the corresponding combustion chamber recess 15 and an upstream section into which the two downstream sections merge. The intake passages 16 extend independently from each other from the respective combustion chamber recess 15 in a rearward direction, and open out at the rear side 3A of the cylinder head 3. An intake manifold not shown in the drawings is attached to the rear side 3A of the cylinder head 3 to merge the intake passages 16 into a single inlet passage.

The exhaust passage 17 includes a plurality of branch passages 18 extending forward from the respective combustion chamber recesses 15 by pairs, and the branch passages 18 merge into a single collecting passage 19 that opens out at the front side 3B of the cylinder head 3 at the downstream end thereof. Each combustion chamber recess 15 communicates with the corresponding two of the branch passages 18. The collecting passage 19 includes an exhaust chamber 19A elongated in the cylinder row direction and directly communicating with the branch passages 18, and a chamber downstream passage 19B extending forward from the central portion of the exhaust chamber 19A with respect to the cylinder row direction and progressively narrowing to a downstream end thereof that opens out at the front side 3B of the cylinder head 3. The cylinder head 3 is thus internally incorporated with an exhaust manifold.

As shown in FIG. 2, an intake valve 21 is provided at an end of each intake passage 16 opening out to the corresponding combustion chamber recess 15, and an exhaust valve 22 is provided at an end of each branch passage 18 of the exhaust passage 17 opening out to the corresponding combustion chamber recess 15. The intake valves 21 and the exhaust valves 22 are driven to be opened and closed by a valve actuating mechanism 23 which is provided in a valve actuating chamber 24 jointly defined by the cylinder head 3 and the head cover 5.

The valve actuating mechanism 23 includes an intake camshaft 27 and an exhaust camshaft 28, valve springs 29 that urge the intake valves 21 and the exhaust valves 22 in the closing direction, and intake rocker arms 31 and exhaust rocker arms 32 for transmitting a driving force of the intake camshaft 27 and the exhaust camshaft 28 to the corresponding intake valves 21 and the corresponding exhaust valves 22, respectively.

Figure 3:
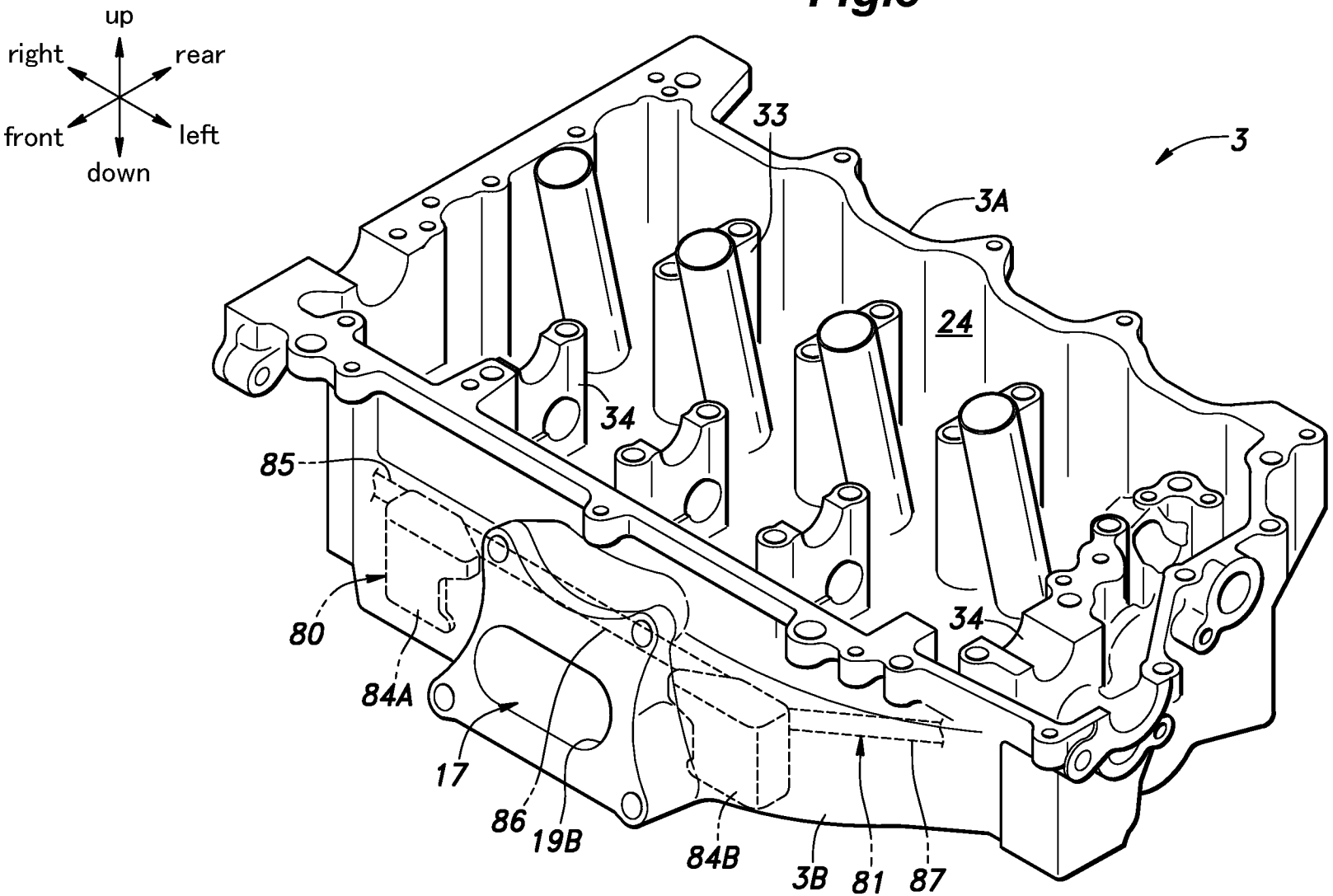
FIG. 3 is a perspective view of a cylinder head of the internal combustion engine.

As shown in FIG. 3, a plurality of intake camshaft bearings 33 for rotatably supporting the intake camshaft 27 and a plurality of exhaust camshaft bearings 34 for rotatably supporting the exhaust camshaft 28 are provided on the upper part of the cylinder head 3. As shown in FIG. 1, the right ends of the crankshaft 11, the intake camshaft 27 and the exhaust camshaft 28 are provided with respective sprockets 11A, 27A, 28A, and a timing chain 35 is passed around the sprockets 11A, 27A and 28A so that the intake camshaft 27 and the exhaust camshaft 28 are synchronized with the crankshaft 11 and rotate at one half the rotational speed of the crankshaft 11.

As shown in FIG. 2, the intake rocker arms 31 are rotatably supported by the respective rocker shafts 36. A variable lift mechanism 37 actuated by hydraulic pressure is provided in association with the intake camshaft 27 and the intake rocker arms 31. The variable lift mechanism may consist of a per se known mechanism, and includes high lift cams and a low lift cams provided on the intake camshaft 27. The intake rocker arms 31 include high lift rocker arms and low lift rocker arms. The high lift rocker arms are actuated by the high lift cams, and the low lift rocker arms are actuated by the low lift cams. Connecting pins (not shown in the drawings) are configured to be displaced upon receipt of hydraulic pressure to selectively disconnect the high lift rocker arms and the low lift rocker arms. When the high lift rocker arms and the low lift rocker arms are connected to each other by the connecting pins, the intake valves 21 are opened with a relatively high lift provided by the high lift cams. When the high lift rocker arms and the low lift rocker arms are disconnected from each other, the intake valves 21 are opened with a relatively low lift provided by the low lift cams.

Each exhaust rocker arm 32 is pivotally supported by a lash adjuster 41 which may consist of a per se known hydraulic lash adjuster (hydraulic tappet), and is configured to automatically set the gap between the exhaust rocker arm 32 and the exhaust cam to zero by receiving a supply of hydraulic pressure thereto. The lash adjuster 41 includes a cylindrical body 42 defining a cylindrical hole having a closed bottom end and fitted into an HLA receiving hole 44 formed in the cylinder head 3, and a plunger 43 received in the cylindrical hole of the cylindrical body 42 so as to protrude and retreat from and into the cylindrical body 42 as required to fill the gap between the exhaust rocker arm 32 and the exhaust cam. An oil chamber is formed between the lower end of the plunger 43 and the bottom of the cylindrical hole of the cylindrical body 42. An oil receiving hole 42A is formed in a side portion of the cylindrical body 42, and a connecting passage (not shown in the drawings) connecting the oil receiving hole 42A with the oil chamber is formed in the plunger 43. In the oil chamber are provided a check ball (not shown in the drawings) for opening and closing the opening end of the connecting passage, and a spring for urging the check ball toward the open end of the connection passage and urging the plunger 43 in the direction of protruding from the cylindrical body 42. The base end of the exhaust rocker arm 32 is pivotably supported by the upper end of the plunger 43. The connecting passage extends to the upper end of the plunger and supplies the lubricating oil to the sliding contact surface of the plunger 43 engaging the base end of the exhaust rocker arm 32.

Figure 5:
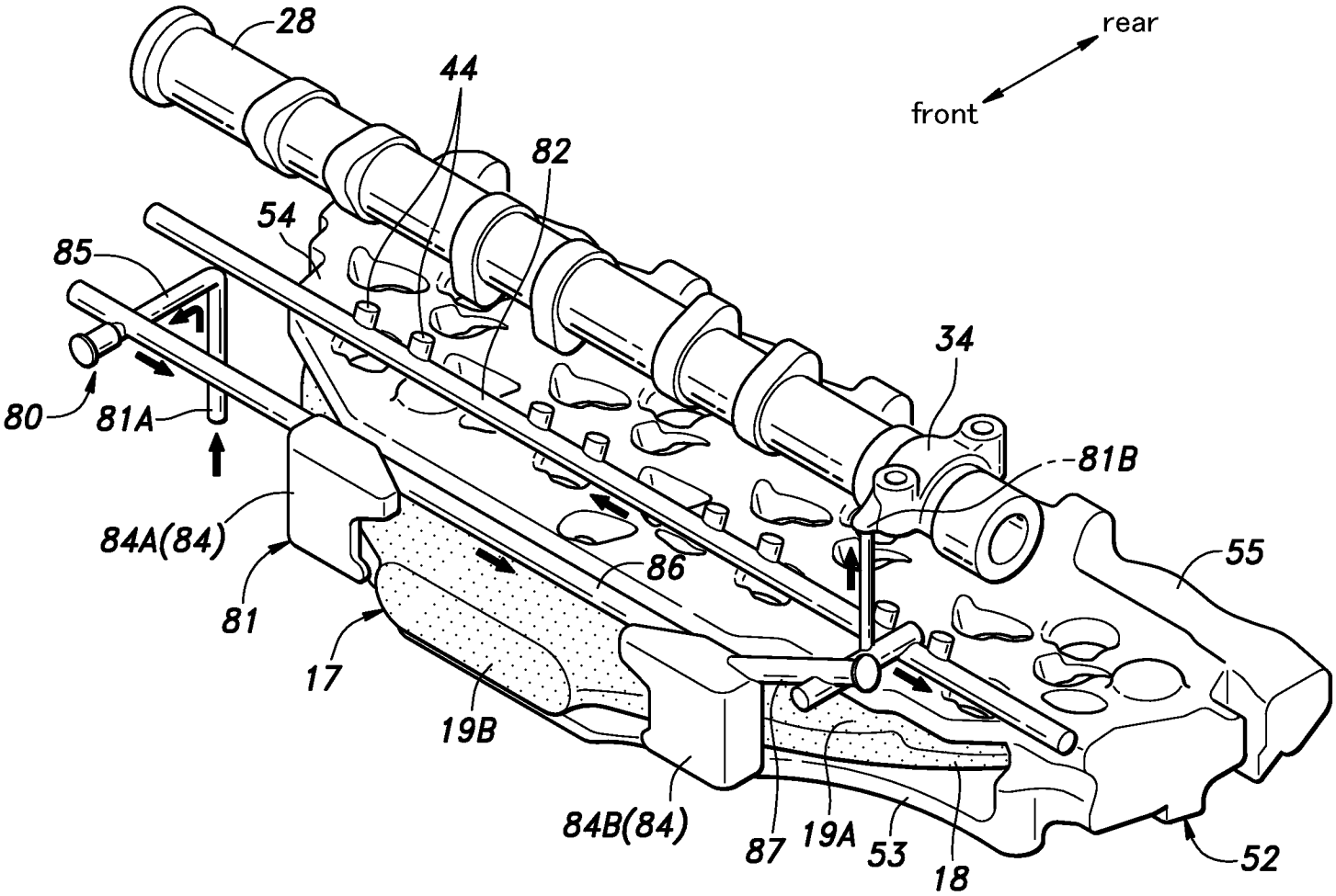
FIG. 5 is a see-through perspective view of an exhaust passage, a head water jacket and a head exhaust side oil passage formed in the cylinder head.

A block side water jacket 51 is formed around the cylinders 8 in the cylinder block 2. The block side water jacket 51 opens to the upper end face of the cylinder block 2. A head side water jacket 52 is formed around the combustion chamber recesses 15 and the exhaust passage 17 in the cylinder head 3. As shown in FIGS. 2 and 5, the head side water jacket 52 includes a lower water jacket 53 formed under the exhaust passage 17 (on the side of the cylinder block 2), an upper water jacket 54 formed above the combustion chamber recess 15 and the exhaust passage 17 (remote from the side of the cylinder block 2), and an intake side water jacket 55 formed under the intake passages 16. The lower water jacket 53, the upper water jacket 54 and the intake side water jacket 55 are communicated with one another. The lower water jacket 53 and the intake side water jacket 55 open out to the lower end face of the cylinder head 3, and are connected to the block side water jacket 51. The lower water jacket 53 and the upper water jacket 54 are each provided with a relatively small vertical dimension in relation to a lateral and a fore and aft dimension thereof, and relatively elongated in the cylinder row direction. The lower water jacket 53 and the upper water jacket 54 are each narrower in the front side thereof than in the rear side thereof (as measured in the cylinder row direction) so as to correspond to the shape of the exhaust passage 17. The front edge (the part corresponding to the downstream end of the exhaust passage 17) of the upper water jacket 54 is located behind the front edge of the lower water jacket 53. In other words, the front edge of the upper water jacket 54 is more remote from the front side 3B of the cylinder head 3 than the front edge of the lower water jacket 53.

The block side water jacket 51 and the head side water jacket 52 are connected to a cooling water circuit including a water pump and a radiator, and constitute a part of a cooling water recirculation system. The cooling water (or the engine coolant) flows from the block side water jacket 51 to the intake side water jacket 55 or the lower water jacket 53 of the head side water jacket 52, and then flows to the upper water jacket 54.

Figure 6:
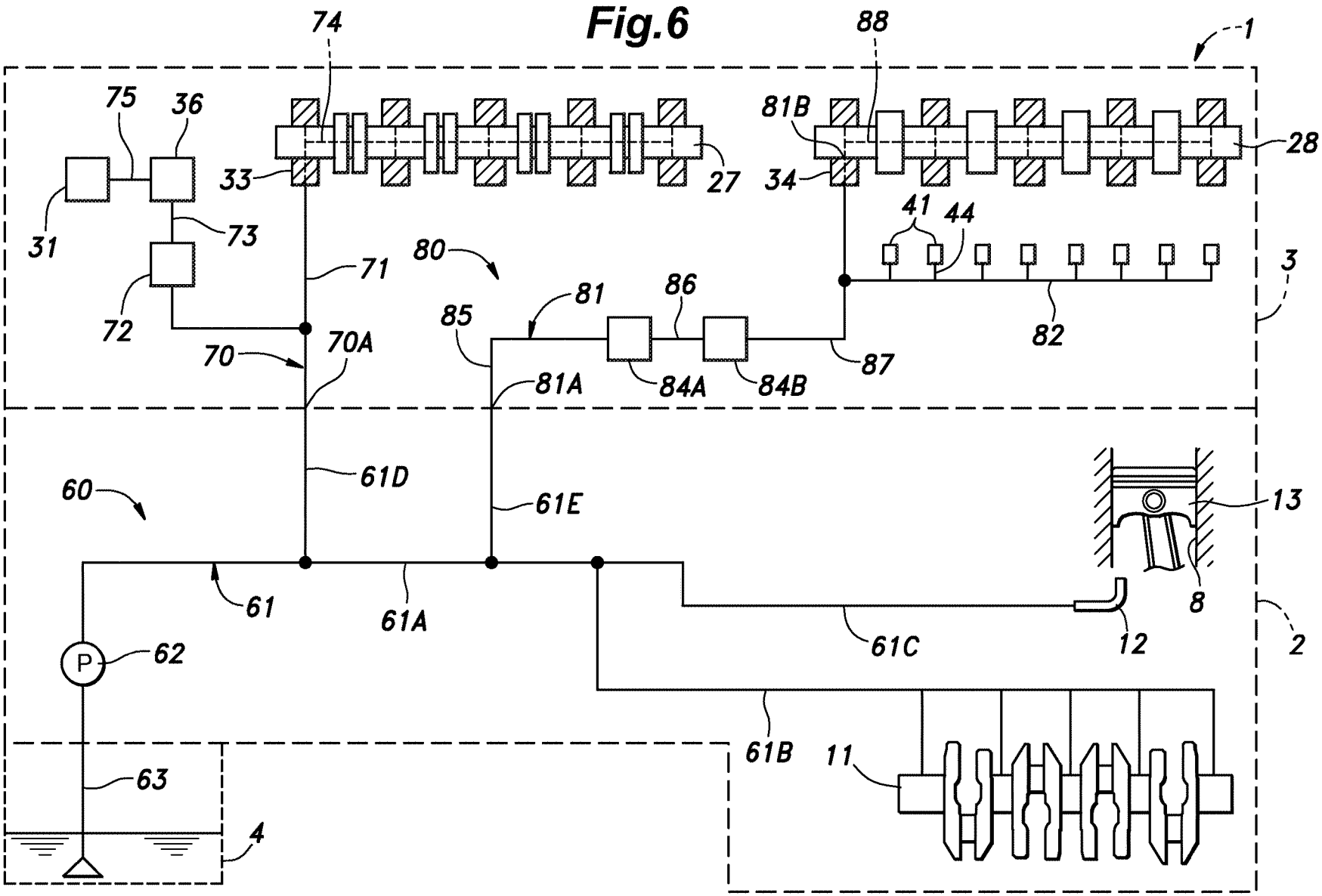
FIG. 6 is a circuit diagram of a lubrication system of the internal combustion engine.

FIG. 6 is an oil circuit diagram of the lubricating system 60 of the internal combustion engine 1. As shown in FIG. 6, a block side oil passage 61 is formed in the cylinder block 2. The block side oil passage 61 includes a main gallery 61A connected to the discharge port of an oil pump 62, a crankshaft oil passage 61B extending from the main gallery 61A to sliding contact surfaces of the bearings supporting the crankshaft 11, an oil jet oil passage 61C extending from the main gallery 61A to oil jets 12 that inject the lubricating oil toward the back surfaces of the pistons 13, and a block intake side oil passage 61D and a block exhaust side oil passage 61E both extending from the main gallery 61A to the upper end face of the cylinder 8. The suction port of the oil pump 62 is connected to a suction pipe 63. The open end of the suction pipe 63 is placed under the oil surface of the lubricating oil stored in the oil pan 4. The oil pump 62 may consist of a per se known trochoid pump, and the drive shaft of the oil pump 62 is connected to the crankshaft 11 via a gear or chain transmission mechanism not shown in the drawings.

The cylinder head 3 is provided with a head intake side oil passage 70 and a head exhaust side oil passage 80 for supplying lubricating oil to the intake side and the exhaust side of the valve actuating mechanism 23, respectively. The head intake side oil passage 70 includes an intake camshaft oil passage 71 which extends from an upstream end 70A of the head intake side oil passage 70 opening out at the lower end face of the cylinder head 3, and connected to the block intake side oil passage 61D, to the sliding contact surfaces of the intake camshaft bearings 33, and a rocker shaft oil passage 73 extending from the upstream end 70A to the rocker shafts 36 via a hydraulic control device 72. The intake camshaft 27 is provided with an intake camshaft oil passage 74 that extends from the sliding contact surface of the intake camshaft bearing 33 at which the intake camshaft oil passage 71 opens out, to the sliding contact surfaces of the other intake camshaft bearings 33. Each rocker shaft 36 is provided with a rocker shaft inner oil passage 75 connecting the rocker shaft oil passage 73 with a support hole for receiving the corresponding coupling pin of the intake rocker arm 31. The hydraulic control device 72 performs the coupling and decoupling between the high lift rocker arm and the low lift rocker arm via the coupling pin by controlling the supply of hydraulic pressure to the rocker shaft inner oil passages 75.

As shown in FIGS. 5 and 6, the head exhaust side oil passage 80 includes a main oil passage 81 provided with an upstream end 81A (first end) that opens out at the lower end surface of the cylinder head 3 and is connected to the block exhaust side oil passage 61E and a downstream end 81B (second end) that opens out at the sliding surfaces of the exhaust camshaft bearings 34, and an HLA oil passage 82 that branches off from the main oil passage 81 and extends to the respective HLA receiving holes 44. An oil jacket 84 is formed around the exhaust passage 17 in the path of the main oil passage 81.

The oil jacket 84 includes a first oil jacket 84A disposed on one side (right side) of the chamber downstream passage 19B of the collecting passage 19 and a second oil jacket 84B arranged on the other side (left side) of the chamber downstream passage 19B of the collecting passage 19. Each oil jacket 84A, 84B has a flat shape or has a small dimension in the fore and aft direction as compared to a vertical and a lateral dimension thereof. The upper edges of the oil jackets 84A and 84B are located above the upper edge of the chamber downstream passage 19B and the lower edges of the oil jackets 84A and 84B are positioned below the lower edge of the chamber downstream passage 19B. The upper end and the lower end of the side portion of the first oil jacket 84A protrude toward the chamber downstream passage 19B, and the upper end and the lower end of the side portion of the second oil jacket 84B protrude toward the chamber downstream passage 19B in a similar fashion so that the parts of the oil jacket 84 adjoining the chamber downstream passage 19B are formed in a complementary shape so as to follow the outer profile of the chamber downstream passage 19B. The parts of the faces of the oil jackets 84A and 84B adjoining the chamber downstream passage 19B (facing away from the front side 3B of the cylinder head 3) are inclined toward the rear as they extend toward each other. Each oil jacket 84A, 84B is disposed further toward the open end side (the front side 3B) of the chamber downstream passage 19B than the edge (front edge) of the upper water jacket 54 on the open end side of the chamber downstream passage 19B.

The main oil passage 81 of the head exhaust side oil passage 80 includes an upstream oil passage 85 connecting the block exhaust side oil passage 61E with the first oil jacket 84A, an upper connecting oil passage 86 connecting the first oil jacket 84A with the second oil jacket 84B, and a downstream oil passage 87 connecting the second oil jacket 84B with the sliding contact surfaces of the exhaust camshaft bearings 34. The upper connecting oil passage 86 extends laterally above the chamber downstream passage 19B, and connects the upper ends of the first and second oil jackets 84A, 84B to each other. The upper connecting oil passage 86 is disposed more toward the open end side (front side) of the chamber downstream passage 19B than the edge (front edge) of the upper water jacket 54 on the open end side of the chamber downstream passage 19B. In other words, the upper connecting oil passage 86 is positioned on an outer side of the edge (front edge) of the upper water jacket 54 on the open end side of the chamber downstream passage 19B. The exhaust camshaft 28 is provided with an exhaust camshaft oil passage 88 extending from the sliding contact surface of the exhaust camshaft bearing 34 at which the downstream oil passage 87 opens out to the sliding contact surfaces of the other exhaust camshaft bearings 34.

An HLA oil passage 82 extends in the cylinder head 3 in the cylinder row direction and is connected between the downstream oil passage 87 and the HLA receiving holes 44. The HLA receiving holes 44 connect the HLA oil passages 82 to the oil receiving holes 42A of the respective lash adjusters 41.

The mode of operation of the internal combustion engine 1 of the first embodiment is described in the following. When the internal combustion engine 1 is in operation, and the oil pump 62 is driven by the internal combustion engine 1, the lubricating oil is supplied to the various sliding contact surfaces of the internal combustion engine 1. The lubricating oil in the first and second oil jackets 84A and 84B and the upper connecting oil passage 86 receives heat from the exhaust gas that flows through the collecting passage 19 of the exhaust passage 17. Because the first and second oil jackets 84A and 84B and the upper connecting oil passage 86 are provided around the chamber downstream passage 19B without being interposed by the upper water jacket 54 or the lower water jacket 53, the lubricating oil can be heated to a higher temperature than the cooling water. The lubricating oil heated in the first and second oil jackets 84A and 84B and the upper connecting oil passage 86 is supplied to the sliding contact surfaces of the exhaust camshaft bearings 34 and the lash adjusters 41 located immediately downstream of the second oil jacket 84B substantially without decreasing the temperature thereof. As a result, the lubricating oil is allowed to lubricate the exhaust camshaft bearings 34 and the lash adjusters 41 with a reduced viscosity so that the frictional loss in the exhaust camshaft bearings 34 and the lash adjusters 41 is minimized, and the fuel economy of the vehicle can be improved.

Because the first and second oil jackets 84A and 84B are positioned on either side of the chamber downstream passage 19B, the first and second oil jackets 84A and 84B are prevented from being interfered by the upper water jacket 54 and the lower water jacket 53 which are located above and below the chamber downstream passage 19B. As a result, the first oil jacket 84A, the second oil jacket 84B, the upper water jacket 54 and the lower water jacket 53 can be positioned in the cylinder head 3 in a space efficient manner, and the size of the cylinder head 3 can be minimized. Furthermore, the first oil jacket 84A and the second oil jacket 84B can be positioned closer to the chamber downstream passage 19B than is otherwise possible.

Because the first oil jacket 84A and the second oil jacket 84B have a larger cross sectional area than the upstream oil passage 85 and the downstream oil passage 87, the velocity of the lubricating oil in the first oil jacket 84A and the second oil jacket 84B is reduced so that the lubricating oil receives a comparatively large amount of heat, and the temperature of the lubricating oil can be increased.

Second Embodiment

As shown in FIG. 6, in the internal combustion 1 of the second embodiment, a lower connecting oil passage 101 is provided instead of the upper connecting oil passage 86 of the previous embodiment. The lower connecting oil passage 101 extends under the chamber downstream passage 19B, and is connected between the lower ends of the first oil jacket 84A and the second oil jacket 84B. The lower connecting oil passage 101 is positioned more toward the open end side of the chamber downstream passage 19B than the edge (front edge) of the lower water jacket 53 on the side of the chamber downstream passage 19B. In order to secure a space in the cylinder head 3 for accommodating the lower connecting oil passage 101, the front edge of the lower water jacket 53 of the second embodiment may be located more behind than the front edge of the lower water jacket 53 of the first embodiment. Because of the absence of the upper connecting oil passage 86 (of the first embodiment), the front edge of the upper water jacket 54 of the second embodiment may be positioned more ahead of the front edge of the upper water jacket 54 of the first embodiment. In the second embodiment, the upstream oil passage 85 is connected to the lower end of the first oil jacket 84A. The lower connecting oil passage 101 and the upstream oil passage 85 may have a generally downward inclination toward the upstream side thereof.

In the internal combustion 1 of the second embodiment, when the engine is not in operation, the lubricating oil remaining in the second oil jacket 84B flows to the first oil jacket 84A via the lower connecting oil passage 101, and the lubricating oil remaining in the first oil jacket 84A flows toward the oil pan 4 via the upstream oil passage 85, under the gravitational force. Therefore, when the engine 1 is not in operation, the lubricating oil is prevented from remaining in the first oil jacket 84A and the second oil jacket 84B.

Third Embodiment

Figure 7:
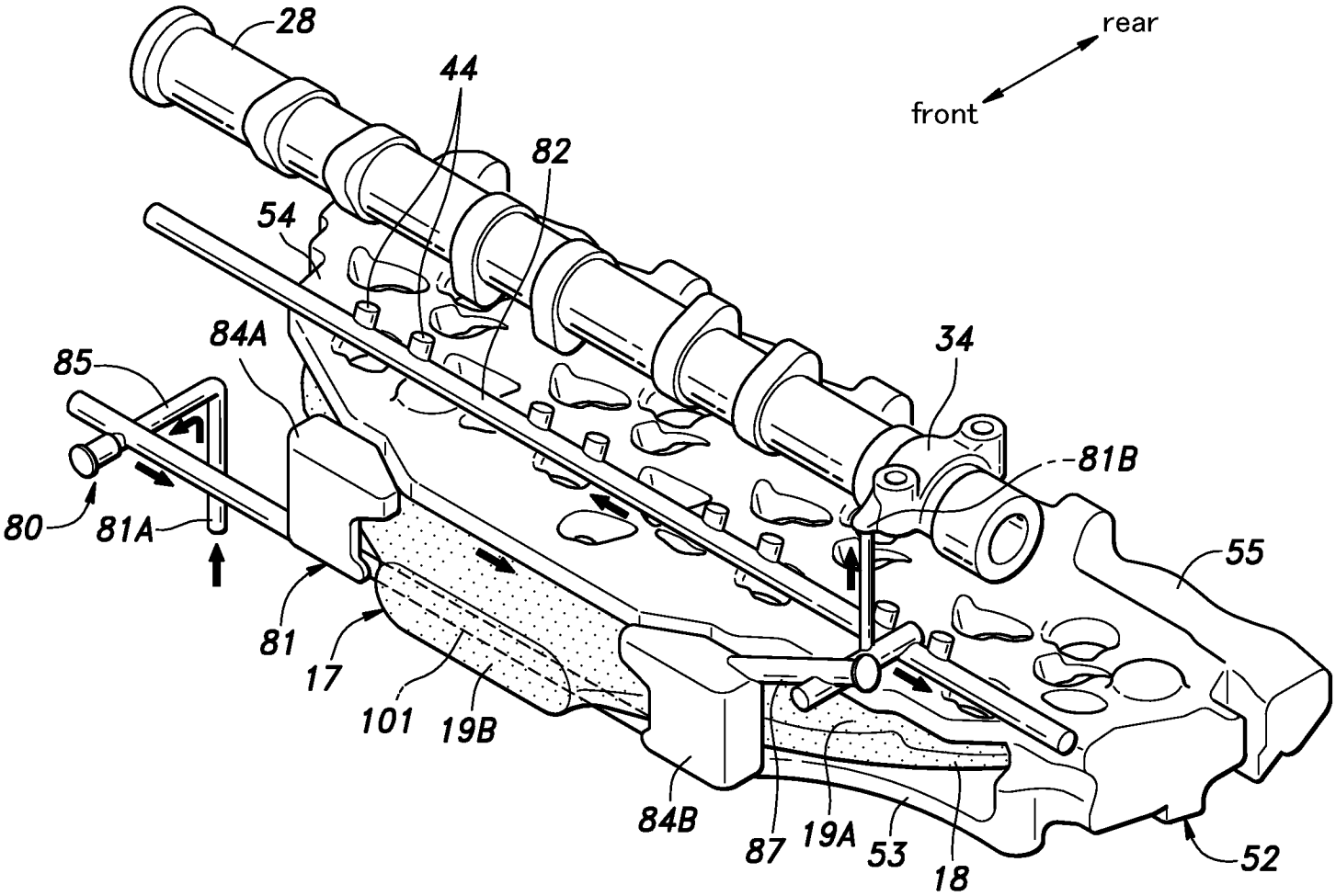
FIG. 7 is a view similar to FIG. 5 showing a cylinder head according to a second embodiment of the present invention.
Figure 8:
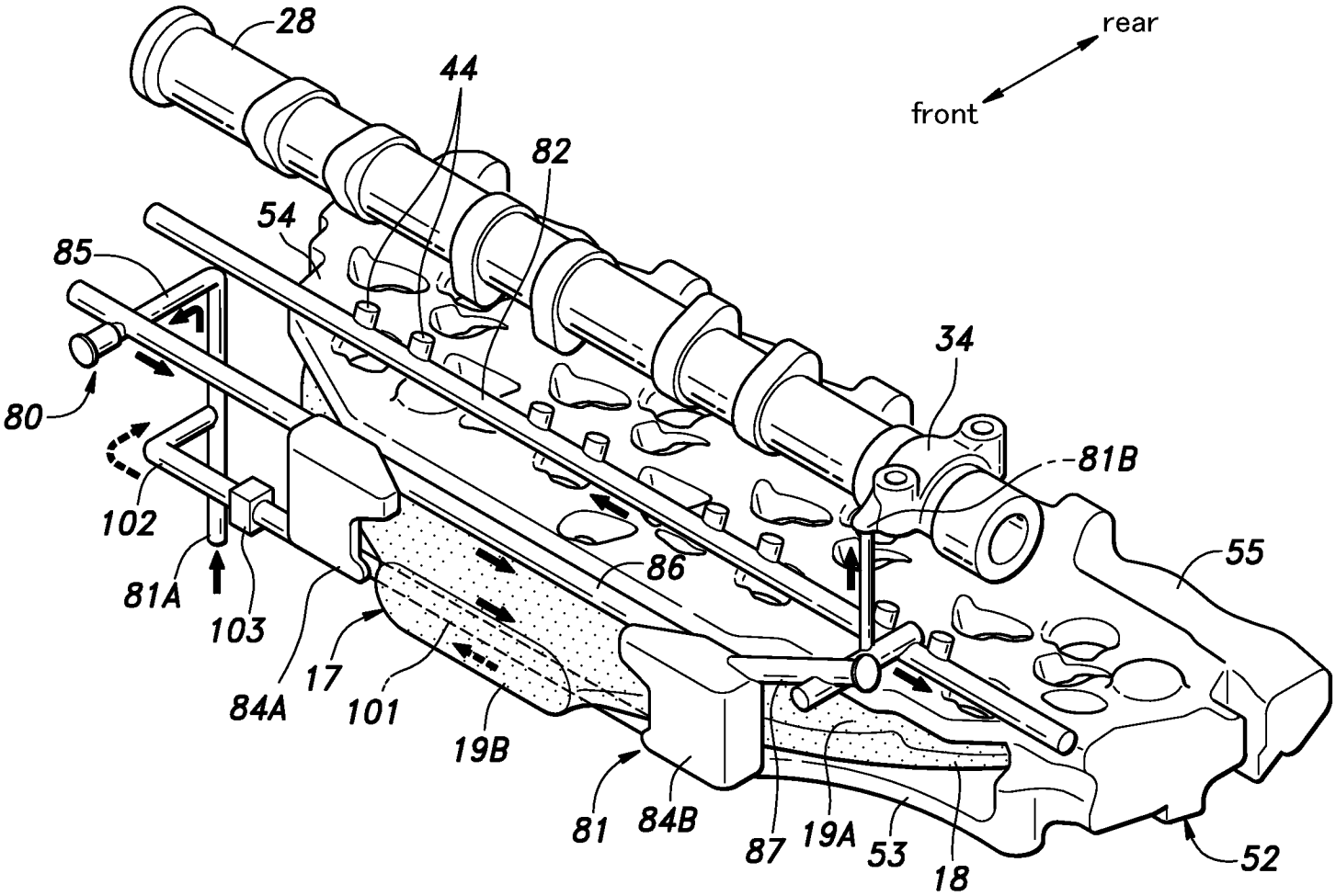
FIG. 8 is a view similar to FIG. 5 showing a cylinder head according to a third embodiment of the present invention.

As shown in FIG. 7, in the internal combustion 1 of the third embodiment, both the upper connecting oil passage 86 of the first embodiment, and the lower connecting oil passage 101 of the second embodiment are provided. Additionally, a discharge passage 102 is connected between the lower end of the first oil jacket 84A and the upstream oil passage 85. The lower connecting oil passage 101 and the discharge passage 102 extend horizontally. Alternatively, the lower connecting oil passage 101 and the discharge passage 102 may extend with a downward incline in the upstream direction (or toward the upstream passage 85). The discharge passage 102 is provided with a one-way valve 103 that permits a flow from the first oil jacket 84 to the upstream passage 85, and prohibits a flow in the opposite direction.

In the internal combustion 1 of the third embodiment, when the engine 1 is in operation, because the pressure of the upstream oil passage 85 is higher than that of the first oil jacket 84A, the one-way valve 103 closes so that the lubricating oil flows through the upstream passage 85, the first oil jacket 84A, the upper connecting oil passage 86 or the lower connecting oil passage 101, the second oil jacket 84B and the downstream oil passage 87, in that order. On the other hand, when the engine 1 is not in operation, because the pressure of the upstream oil passage 85 is low, the head pressure of the lubricating oil in the first oil jacket 84A causes the one-way valve 103 to open so that the lubricating oil can flow from the first oil jacket 84A back to the upstream oil passage 85 via the discharge passage 102. Therefore, when the engine 1 is not in operation, the lubricating oil is prevented from remaining in the first oil jacket 84A and the second oil jacket 84B. When the engine 1 is in operation, the one-way valve 103 prohibits the lubricating oil from flowing from the first oil jacket 84A to the upstream oil passage 85 via the discharge passage 102 so that the lubricating oil is allowed to flow from the upstream oil passage 85 to the first oil jacket 84A and further downstream in a stable manner.

Although the present invention has been described in terms of preferred embodiments thereof, it is obvious to a person skilled in the art that various alterations and modifications are possible without departing from the spirit of the present invention. For instance, the lubricating oil that has passed through the first and second oil jackets 84A and 84B may be supplied to other sliding contact surfaces such as intake camshaft bearings 33, instead of or additionally to the exhaust camshaft bearings 34 and the lash adjusters 41.

The oil jacket 84 may be configured differently from the first and second oil jackets 84A and 84B. The oil jacket 84 may be formed in an annular configuration so as to surround the chamber downstream passage 19B. Also, the oil jacket 84 may extend laterally so as to be positioned above and/or below the chamber downstream passage 19B and/or the exhaust chamber 19A.

The head exhaust side oil passage 80 may not be connected to a valve actuating mechanism or, in other words, the main oil passage may not open out to the sliding contact surfaces of the exhaust camshaft bearings 34. Also, no HLA oil passage 82 may be provided in the cylinder head 3. In such a case, the lubricating oil that has passed through the oil jacket 84 may be directly returned to the oil pan 4.

The invention claimed is:

1. An internal combustion engine, comprising:

a cylinder head;

a combustion chamber recess formed in the cylinder head;

an intake passage and an exhaust passage formed in the cylinder head and communicating with the combustion chamber recess;

a head oil passage formed in the cylinder head, and having a first end communicating with an oil pump and a second end opening out at a sliding contact surface of a valve actuating mechanism provided in the cylinder head; and an oil jacket formed in the cylinder head in a path of the head oil passage so as to at least partly surround the exhaust passage, wherein the oil jacket is provided with a larger cross sectional area than an adjoining part of the head oil passage; and wherein the cylinder head is provided with a plurality of combustion chamber recesses, and the exhaust passage includes a plurality of branch passages communicating with the respective combustion chamber recesses, and a collecting passage connected to downstream ends of the branch passages and opening out at a side of the cylinder head, the oil jacket being positioned adjacent to the collecting passage.

2. The internal combustion engine according to claim 1, wherein the oil jacket is positioned on a side of the collecting passage.

3. The internal combustion engine according to claim 2, wherein the oil jacket has an upper edge positioned above an upper end of the collecting passage, and a lower edge positioned below a lower end of the collecting passage.

4. The internal combustion engine according to claim 2, wherein the oil jacket includes a first oil jacket positioned on one side of the collecting passage and a second oil jacket positioned on another side of the collecting passage; and wherein the head oil passage includes an upper connecting oil passage extending above the collecting passage and connecting the first oil jacket with the second oil jacket and/or a lower connecting oil passage extending below the collecting passage and connecting the first oil jacket with the second oil jacket, an upstream oil passage connecting the first oil jacket with the oil pump, and a downstream oil passage connecting the second oil jacket with the second end of the head oil passage.

5. The internal combustion engine according to claim 4, wherein the head oil passage includes both the upper connecting oil passage and the lower connecting oil passage, and is further provided with a discharge passage extending from a lower end of the first oil jacket to the upstream oil passage with a downward incline, the lower connecting oil passage extending from the second oil jacket to the first oil jacket horizontally or with a downward inline.

6. The internal combustion engine according to claim 5, further comprising a one-way valve in the discharge passage allowing a flow from the first oil jacket to the upstream oil passage.

7. The internal combustion engine according to claim 2, wherein the oil jacket includes a first oil jacket positioned on one side of the collecting passage and a second oil jacket positioned on another side of the collecting passage;

the head oil passage includes an upper connecting oil passage extending above the collecting passage and connecting the first oil jacket with the second oil jacket, an upstream oil passage connecting the first oil jacket with the oil pump, and a downstream oil passage connecting the second oil jacket with the second end of the head oil passage;

the cylinder head is provided with an upper water jacket formed above the exhaust passage and a lower water jacket formed under the exhaust passage; and the upper connecting oil passage is positioned more toward a downstream end of the collecting passage than an edge of the upper water jacket on a side of the downstream end of the collecting passage.

8. The internal combustion engine according to claim 7, wherein the first oil jacket and the second oil jacket are positioned more toward the downstream end of the collecting passage than the edge of the upper water jacket on the side of the downstream end of the collecting passage.

9. The internal combustion engine according to claim 1, wherein the second end of the head oil passage opens out at a sliding contact surface of a bearing provided on the cylinder head for rotatably supporting a camshaft.

10. The internal combustion engine according to claim 1, wherein the second end of the head oil passage opens out at a lash adjuster receiving hole formed in the cylinder head for supporting a lash adjuster.

* * * * *